US008354604B2

(12) United States Patent
Park et al.

(10) Patent No.: US 8,354,604 B2
(45) Date of Patent: Jan. 15, 2013

(54) AUTO TRANSFER SWITCH INCLUDING COVER

(75) Inventors: No-Chun Park, Seoul (KR); Choong-Hyun Lee, Seoul (KR)

(73) Assignee: Vitzrotech Co., Ltd., Gyeonggi-do (KR)

( * ) Notice: Subject to any disclaimer, the term of this patent is extended or adjusted under 35 U.S.C. 154(b) by 255 days.

(21) Appl. No.: 12/771,771

(22) Filed: Apr. 30, 2010

(65) Prior Publication Data

US 2010/0276266 A1 Nov. 4, 2010

(30) Foreign Application Priority Data

May 4, 2009 (KR) ..... 20-2009-0005365 U

(51) Int. Cl.
*H01H 9/00* (2006.01)

(52) U.S. Cl. ..... 200/293; 200/306

(58) Field of Classification Search ..... 200/51.06, 200/50.32, 50.33, 293, 303, 304, 305, 306, 200/307; 307/64, 80, 112, 113, 115, 119, 307/126, 137, 29; 335/6, 11, 13, 14, 161, 335/171–179; 361/114, 115
See application file for complete search history.

(56) References Cited

U.S. PATENT DOCUMENTS

| | | | | |
|---|---|---|---|---|
| 4,791,255 | A * | 12/1988 | Eliezer | 218/1 |
| 6,534,737 | B1 * | 3/2003 | Rademacher et al. | 200/401 |
| 6,538,223 | B1 * | 3/2003 | Yoshida et al. | 200/401 |
| 6,815,622 | B2 * | 11/2004 | Milman et al. | 200/5 R |
| 6,849,811 | B1 * | 2/2005 | Heflin et al. | 200/1 R |
| 7,368,677 | B2 * | 5/2008 | Jones et al. | 200/400 |
| 7,385,153 | B1 * | 6/2008 | Bogdon et al. | 200/303 |
| 7,435,920 | B1 * | 10/2008 | Yoo | 200/50.32 |
| 7,683,282 | B2 * | 3/2010 | Kloth et al. | 200/560 |
| 2004/0140188 | A1 * | 7/2004 | Larcher | 200/293 |

FOREIGN PATENT DOCUMENTS

CN 201402749 Y * 2/2010

* cited by examiner

*Primary Examiner* — Michael Friedhofer
(74) *Attorney, Agent, or Firm* — Ohlandt, Greeley, Ruggiero & Perle, LLP

(57) ABSTRACT

A cover of an electrically-connected portion of an auto transfer switch, which is detachable and includes an arc guide portion.

4 Claims, 1 Drawing Sheet

AUTO TRANSFER SWITCH INCLUDING COVER

CROSS-REFERENCE TO RELATED PATENT APPLICATION

This application claims the benefit of Korean Utility Model Application No. 20-2009-0005365, filed on May 4, 2009, in the Korean Intellectual Property Office, the disclosure of which is incorporated herein in its entirety by reference.

BACKGROUND OF THE INVENTION

1. Field of the Invention

The present invention relates to a cover of an electrically-connected portion of an auto transfer switch, which is detachable and includes a guide portion, and more particularly, to a cover of an electrically-connected portion of an auto transfer switch, which includes a guide portion formed at a lower portion of the cover and having a 'v' shape, thereby guiding arc occurring at contacts.

2. Description of the Related Art

Generally, since an electrically-connected portion of an auto transfer switch is exposed out of the auto transfer switch, when the auto transfer switch is used over a long period of time, the insulating properties of the auto transfer switch may deteriorate due to penetration of dust or impurities. Thus, electric accidents may be likely to occur, and electric shocks may occur when an operator contacts the auto transfer switch.

Korean Patent No. 10-0450637 discloses an auto transfer switch including an electrically-connected portion accommodated in a plastic insulating mold case that is completely sealed.

Thus, operators' electric shocks may be prevented, and electric accidents, which occur since dust or impurities penetrate into the auto transfer switch to reduce insulating properties of the auto transfer switch when the auto transfer switch is used over a long period of time, may be prevented from being occurring.

However, when the above-described plastic insulating mold case that is integrally formed, operators' electric accidents can be prevented, but arcing contacts cannot be checked.

When a voltage of the auto transfer switch is high, arc occurs. In addition, due to collision of different poles, heat may be generated to the auto transfer switch, or the auto transfer switch may be melted or burnt out. Thus, although operators' electric accidents can be prevented by using the above-described plastic insulating mold case that is integrally formed, arc having exposed different poles can not be prevented from colliding.

Thus, there is a need for a manner for arc extinguishing in a short period of time. Accordingly, the present applicant provides an auto transfer switch including a detachable cover for checking arcing contacts and preventing collision of arc.

SUMMARY OF THE INVENTION

The present invention provides an auto transfer switch including a detachable cover for checking arcing contacts and preventing collision of arc.

According to an aspect of the present invention, there is provided an auto transfer switch for transferring power between a load-side terminal, and a normal power terminal and an emergency power terminal of both sides of the load-side terminal by moving a pair of movable contactors, the auto transfer switch includes a cover having an arc guiding function and formed at an upper end of the pair of movable contactors.

The cover may be detachable so as to check arcing contacts. The cover may include a guide portion formed on a lower surface of the cover and having a 'v' shape so as to prevent arc from colliding. The cover may include a plurality of holes so as to discharge arc.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
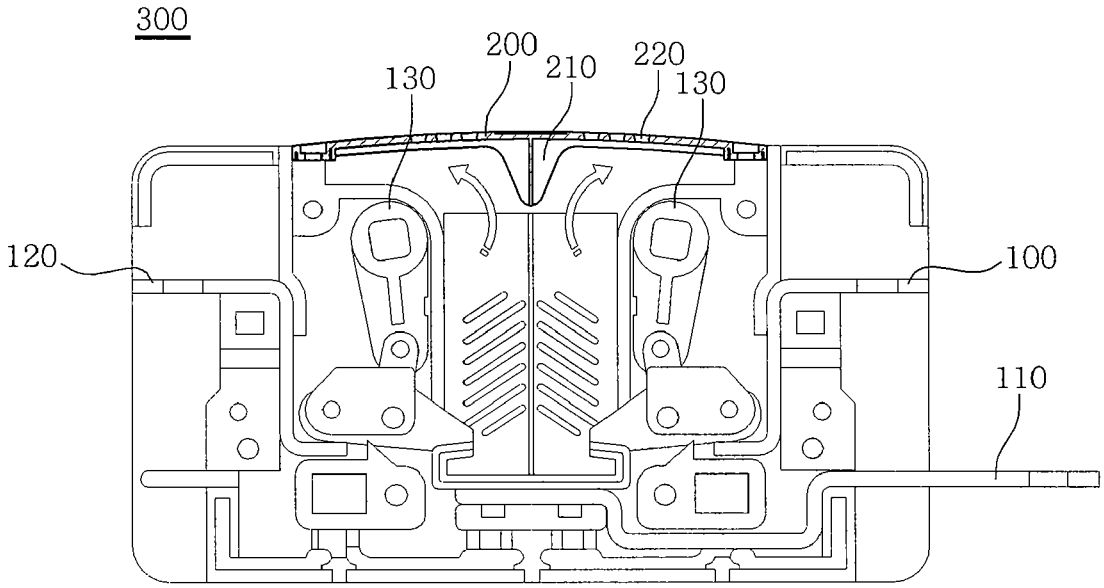
FIG. 1 is a cross-sectional view of an auto transfer switch including a cover, according to an embodiment of the present invention.
Figure 2:
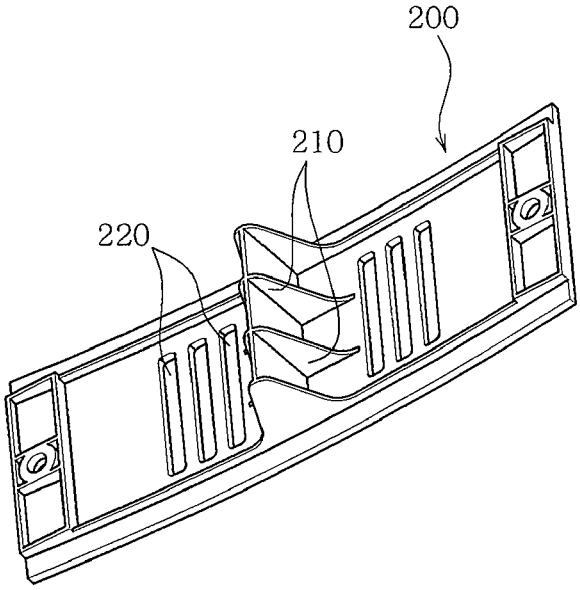
FIG. 2 is a perspective view of the cover of FIG. 1 including a guide portion having a 'v' shape.

FIG. 1 is a cross-sectional view of an auto transfer switch 300 including a cover 200, according to an embodiment of the present invention. FIG. 2 is a perspective view of the cover 200 of FIG. 1 including a guide portion 210 having a 'v' shape.

According to the present embodiment, the auto transfer switch including the cover guides arc occurring at contacts to different directions to protect an electrically-connected portion, and prevents operators' electric accidents.

In addition, the cover includes a guide portion formed at an end of the cover and having a 'v' shape, guiding arc occurring at contacts to achieve arc-extinguishing.

Hereinafter, the present invention will be described in detail by explaining exemplary embodiments thereof with reference to the attached drawings.

FIG. 1 is a cross-sectional view of the auto transfer switch 300 including the cover 200, according to an embodiment of the present invention The auto transfer switch 300 performs power-transfer between two power terminals of a normal power terminal 120 and an emergency power terminal 100 so that power may be supplied to a load-side terminal 110 from the emergency power terminal 100. Power may be transferred between the load-side terminal 110, and the normal power terminal 120 and the emergency power terminal 100 of both sides of the load-side terminal 110 by moving a pair of movable contactors 130.

In this case, if an excessive amount of current is generated during the power-transfer, arc may occur. When arc occurs, the lifetime of the auto transfer switch 300 may be reduced, and manipulation and switch of the auto transfer switch 300 are likely to be failed.

Thus, embodiments of the present invention provide a detachable cover for guiding arc occurring at arcing contacts.

The cover 200 is formed so as to switch the electrically-connected portion of the auto transfer switch 300, and an operator may easily check arcing contacts with the naked eye.

In addition, the cover 200 includes the guide portion 210 formed at a lower portion of the cover 200 and having a 'v' shape.

As indicated as arrows of FIG. 1, since generated arc moves along the guide portion 210 in different directions indicated as different arrows, poles of the arc do not collide.

If performance of arc extinguishing is improved as described above, arcing contacts may be prevented being damaged, thereby increasing the lifetime of the auto transfer switch 300.

FIG. 2 is a perspective view of the cover 200 of FIG. 1 including the guide portion 210 having a 'v' shape.

A plurality of holes 220 are formed in an upper surface of the cover 200, and thus arc may be discharged, and simultaneously the appearance of the auto transfer switch 300 may be improved.

Any insulating material may be used to form the cover 200. In order to form the cover 200 so as to be attached to and detachable from the auto transfer switch 300, a plurality of protrusions are formed on an end surface of the cover 200, and the protrusions are inserted into the holes of the auto transfer switch 300 by using a press fitting method or a screw coupling method. Thus, the cover 200 may be simply attached to and detached from the auto transfer switch 300.

As described above, the auto transfer switch 300 includes the detachable cover 200, and thus operator's safe may be improved.

In addition, although the technology of using the cover 200 in the auto transfer switch 300 is simple, the technological effect is excellent.

According to the auto transfer switch 300 having the above-described structure, due to the detachable cover 200, the issue of an exposed cover may be overcome, and thus operators' electric accidents can be prevented.

In addition, the cover 200 includes the guide portion 210 formed at a central portion of the cover 200 and having a 'v' shape, thereby guiding arc occurring at arcing contacts so as not to collide to discharge the arc in a short period of time.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An auto transfer switch for transferring power between a load-side terminal, and a normal power terminal and an emergency power terminal of both sides of the load-side terminal by moving a pair of movable contactors, wherein the auto transfer switch comprises a cover formed at an upper end of the pair of movable contactors, and wherein the cover comprises a guide portion formed at a central portion on a lower surface of the cover and having a 'v' shape so as to guide arc occurring in the auto transfer switch towards different directions along the guide portion.

2. The auto transfer switch of claim 1, wherein the cover is formed to be detachable.

3. The auto transfer switch of claim 1, wherein the cover comprises at least one hole.

4. An auto transfer switch for transferring power between a load-side terminal, and a normal power terminal and an emergency power terminal of both sides of the load-side terminal by moving a pair of movable contactors, wherein the auto transfer switch comprises a cover formed at an upper end of the pair of movable contactors, and wherein the cover comprises a guide portion formed at a central portion on a lower surface of the cover and having a 'v' shape.

* * * * *